United States Patent [19]

Texidor

[11] Patent Number: 4,872,588

[45] Date of Patent: Oct. 10, 1989

[54] LINED CARTON

[76] Inventor: Teodoro A. Texidor, 6720 N. Navajo, Lincolnwood, Ill. 60646

[21] Appl. No.: 135,499

[22] Filed: Dec. 18, 1987

Related U.S. Application Data

[63] Continuation of Ser. No. 876,688, Jun. 20, 1986.

[51] Int. Cl.[4] ..... B65D 5/56

[52] U.S. Cl. ..... 220/403; 220/404

[58] Field of Search ..... 220/403, 404

[56] References Cited

U.S. PATENT DOCUMENTS

| | | | |
|---|---|---|---|
| 3,233,818 | 2/1966 | Bixler et al. | 220/403 |
| 3,539,360 | 11/1970 | Wood | 220/403 |
| 3,955,743 | 5/1976 | Tanneberger | 220/403 |
| 4,099,665 | 7/1978 | Bergstein | 220/403 |

*Primary Examiner*—Joseph Man-Fu Moy

*Attorney, Agent, or Firm*—Leonard J. Kalinowski

[57] ABSTRACT

A new and improved lined carton having a carton, hinged inner and outer flaps, and a liner inside the carton a portion of which is attached to and along a portion of the outer flap.

10 Claims, 1 Drawing Sheet

LINED CARTON

This is a continuation of application Ser. No. 876,688, filed June 20, 1986, now abandoned.

BACKGROUND OF THE INVENTION

This invention relates to a mechanism for sealing lined cartons. Lined cartons are widely used for dereals and other granular or particulate material and are generally arranged with two hinged flaps. In an effort to keep the product fresh after opening the liner, the present cartons have printed instructions that the liner be pushed down to the level of the cereal or material therein. This is a very poor and insufficient way to keep the product fresh.

An attempt to solve this problem is illustrated by U.S. Pat. No. 3,051,367 entitled "Container", issued Aug. 28, 1962 to Clarence M. Einhorn. The '367 has two hinged flaps that sandwich the liner therebetween, when closed, for an air tight seal. It has a flexible container 14 inside a combination outer container 10 and liner 12. However, the '367 leaves several problems unsolved or unaddressed. (1) The '367 requires the added expense of a double layer container resulting in slower mass production at a greater expense. (2) The '367 is difficult to open or reopen. (3) The flexible container 14 is easily tangled and/or damaged. And (4) when resealing, the consumer can inadvertantly or unsuccessfully stuff the upper portion of the flexible container 14 under the top 13 of the liner 12. Thus, failing to trap the flexible container 14 between cover 11, and top 13, thereby leaving the contents therein unsealed and exposed.

SUMMARY OF THE INVENTION

A principle object of the present invention is to provide a new and improved lined carton having a hinged inner and outer flap, a portion of the liner being sandwiched between the flaps to provide an air-tight seal when in the closed or re-closed position. The sealing is improved considerably by making the inner flap as wide as the end walls so that it fits tightly into the dihedral angle formed by the rear wall and the outer flap when the carton is closed.

Another object of the present invention is to provide a lined carton that automatically pinches the liner between the inner flap and the rear wall of the container further providing an air-tight seal when in the closed or re-closed position.

Another object of the present invention is to provide a lined carton that keeps the contents therein fresher for a longer period of time.

Still another object of the present invention is to provide a lined carton that automatically produces an air tight seal when closed or re-closed.

Yet another object of the present invention is to provide a lined carton which can be easily and inexpensively mass produced.

Yet another object of the present invention is to provide a lined carton with a spout that directs the contents when emptied to a more centralized area.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
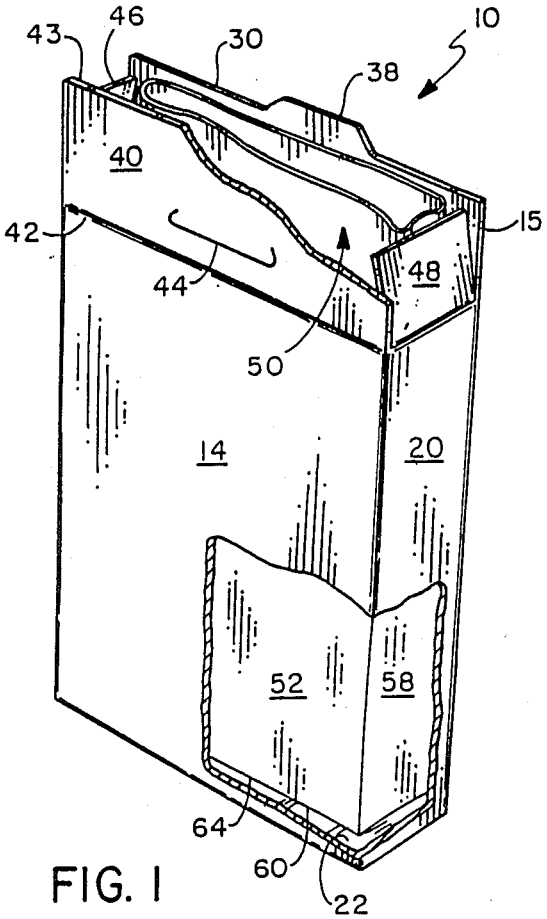
FIG. 1 is a perspective view partially cut away of the lined carton of the present invention.
Figure 2:
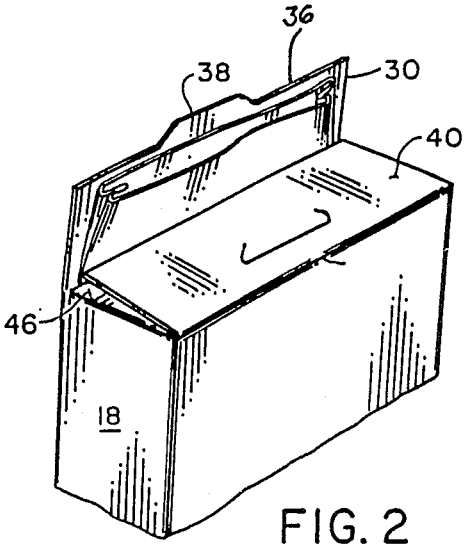
FIG. 2 is a perspective view of the lined carton of the present invention in the partially closed position.
Figure 3:
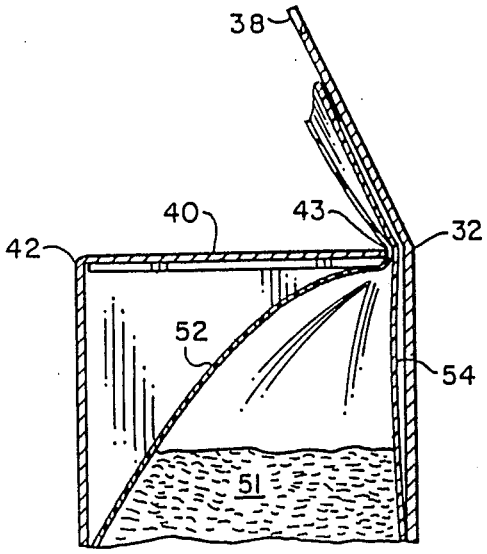
FIG. 3 is an enlarged side view of the lined carton of the present invention in the partially clsoed position.

FIGS. 1 through 4 illustrate the progression from the open to the re-closed positions of the lined carton 10 of the present invention. Generally, the invention comprises a carton 12 having a top 15, a flexible liner 50 having a portion thereof, preferably attaching means 62 bonded to outer flap 30.

More specifically, the carton 12 is preferably made of a cardboard material and has a front wall 14 and rear wall 16 connected by end walls 18 and 20. The carton 12 is rectangular, and is closed at one end by a bottom 22.

The top 15 includes an outer flap 30 attached to rear wall 16 by hinge 32, preferably extending the width of the juncture between the rear wall 16 and edge 36 having a tab 38 extending outwardly therefrom away from the hinge 32. The transverse extent of flap 30 is less than the extent of end walls 18 and 20 of the carton 12.

An inner flap 40 is connected to the front wall 14 and extends the depth of carton 12 from hinge 42 to hinge 32, where it pinches liner 50 between edge 43 and rear wall 16, thus providing an air tight seal in the closed position. Furthermore, flaps 40 and 30 sandwich the liner 50 therebetween to further provide an air tight condition when in the closed position. The transverse extent of flap 40 is substantially the same as the extent of end walls 18 and 20. The inner flap 40 has a slit 44 positioned and dimensioned to receive the tab 38 therein, and to maintain the flaps 30 and 40 in the closed, or overlapping position.

The top 15 also includes two end flaps 46 and 48 which further secure the liner 52 in place, reinforce the carton 12 in the area adjacent thereto, and cooperate with flaps 30 and 40 to accomplish an air tight seal in the closed position.

The flexible liner 50 is housed within carton 12 and has a front wall 52, a rear wall 54, side walls 56 and 58, and a bottom 60. The liner 50 is preferably made of a plastic or wax paper material with dimensions similar to carton 12.

The rear wall 54 of liner 50 is preferably bonded by attaching means 62, or with an adhesive, to a portion of outer flap 30. The precise area where the rear wall 54 of liner 50 is secured to the outer flap 30 is not critical, but the preferred location is near the edge 36, and coextensive with the extent of rear wall 54.

The bonding of attaching means 62, provides: 1) An automatic air tight seal when re-closing, without requiring the consumer to pull up the liner 50, so that it is sandwiched between the flap 30 and 40; 2) the prevention of tangling and/or damage to liner 50; and 3) a spout when pouring that directs the contents to a more centralized area.

Figure 5:
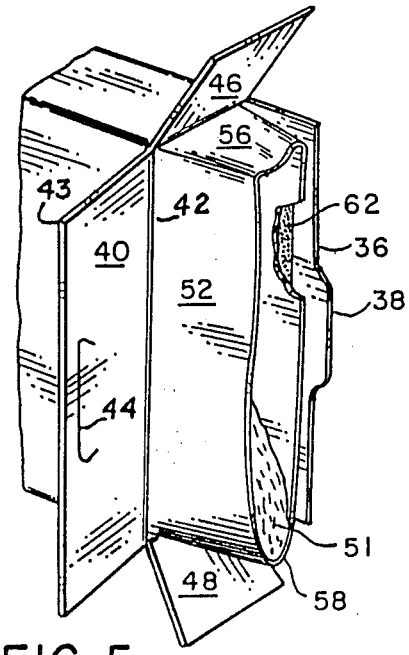
FIG. 5 is a perspective view of the lined carton of the present invention in the pouring position.
Figure 4:
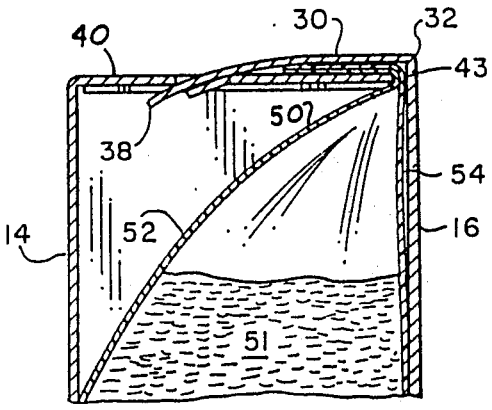
FIG. 4 is an enlarged side view of the lined carton of the present invention in the closed position.

Referring to FIG. 5, when pouring or emptying the contents 51, the side wall 58 of liner 50 is forced open or down, due to gravity. The combination of rear wall 54 bonded to attaching means 62, front wall 52, and side wall 58, combine to form a spout that directs the contents 51 to a more centralized area. It acts similar to a downwardly angled and inwardly sloping grain chute. This spout action occurs when liner 50 is filled, partially filled, or when practically empty, because a portion of liner 50 bottom 60 is bonded by attaching means 64 to carton 12 bottom 22, thus effectively providing tension from bottom 60 to attaching means 62 of flap 30 at all times.

While there has been described what at present is considered to be the preferred embodiment of the present invention, it will be understood that various modifications and alterations may be made therein without departing from the true scope of the invention which is intended to be covered by the claims appended hereto.

I claim:

1. In a reclosable lined carton having first and second side walls, first and second end walls, a closed bottom and an open top defined by the upper marginal edges of said walls, and a liner including opposed sheets forming a receptacle having a closed bottom and an open top for storing a commodity within the carton, the improvement comprising:

an inner closure flap hingedly secured to said first side wall along the upper marginal edge thereof and movable between open and closed positions, an outer closure flap hingedly secured to said second side wall along the upper marginal edge thereof and flap overlying a portion of said inner closure flap when said closure flaps are in their closed positions, the length of the liner from top to bottom being greater than the length of said side walls from top to bottom, defining a liner upper portion which extends between said closure flaps when said closure flaps are in the open position, and means bonding said liner upper portion to a portion of the inner surface of said outer closure flap whereby, as said outer closure flap is moved between its open and closed positions, said liner upper portion is moved with said outer closure flap, said inner closure flap conforming in length and width to the length and width of the cross-section of the carton whereby when said inner closure flap is moved to its closed position, its outer marginal edge is located at the junction of said second side wall and said outer closure flap with said outer marginal edge fitting tightly into the dihedral angle formed by said second side and said outer closure flap, pinching the liner therebetween along the entire length of the junction of said second side and said outer closure flap, and upon subsequent movement of said outer closure flap to its closed position, said liner upper portion of the liner is located between the outer surface of said inner closure flap and the inner surface of said outer closure flap, providing a substantially air-tight seal for the liner.

2. The lined carton as claimed in claim 1, wherein the carton is made of cardboard.

3. The lined carton as claimed in claim 1, wherein said outer closure flap is narrower than said inner closure flap.

4. The lined carton as claimed in claim 3, wherein the outer most edge of said outer closure flap defines a tab which protrudes outwardly therefrom, and said inner closure flap defines a slit for receiving said tab.

5. The lined carton as claimed in claim 1, wherein the liner is bonded parallel to and along a portion of said outer closure flap.

6. The lined carton as claimed in claim 1, further comprising means attaching a portion of the bottom of said liner to a bottom portion of the carton.

7. In a reclosable lined carton having first and second side walls, first and second end walls, a closed bottom and an open top defined by the upper marginal edges of said walls, and a liner including opposed sheets forming a receptacle having a closed bottom and an open top for storing a commodity within the carton, the improvement comprising:

an inner closure flap having a fixed edge hingedly secured to said first side wall along the upper marginal edge thereof and a free edge extending parallel to said fixed edge, said inner closure flap being movable between open and closed positions, an outer closure flap having a fixed edge hingedly secured to said second side wall along the upper marginal edge thereof and a free edge extending parallel to said fixed edge, said outer closure member being movable between open and closed positions, the length of said outer closure flap between its fixed edge and its free edge being less than the length of said inner closure flap and said outer closure flap overlying a portion of said inner closure flap when said closure flaps are in their closed positions, the length of the liner from top to bottom corresponding to the combined length of said second side wall and said outer closure flap, defining a liner upper portion which extends between said closure flaps when said closure flaps are in the open position, and means bonding said liner upper portion to a portion of the inner surface of said outer closure flap along substantially the entire length of said outer closure flap whereby, as said outer closure flap is moved between its open and closed positions, said liner upper portion is moved with said outer closure flap, said inner closure flap conforming in length and width to the length and width cross-section of the carton whereby when said inner closure flap is moved to its closed position, its outer marginal edge is located at the junction of said second side wall and said outer closure flap, with said outer marginal edge fitting tightly into the dihedral angle formed by said second side and said outer closure flap, pinching the liner therebetween along the entire length of the junction of said second side and said outer closure flap, and upon subsequent movement of said outer closure flap to its closed position, said liner upper portion of the liner is located between the outer surface of said inner closure flap and the inner surface of said outer closure flap, providing a substantially air-tight seal for the liner.

8. The lined carton as claimed in claim 7, wherein the liner and the carton have substantially the same volume when the liner and the carton are in the open positions.

9. The lined carton as claimed in claim 7, further comprising means adhesively binding the bottom of the liner to the bottom of the carton.

10. In a reclosable lined carton having first and second side walls, first and second end walls, a closed bottom and an open top defined by the upper marginal edges of said walls, and a liner including opposed sheets forming a receptacle having a closed bottom and an open top for storing a commodity within the carton, the improvement comprising:

an inner closure flap hingedly secured to said first side wall along the upper marginal edge thereof and movable between open and closed positions, an outer closure flap hingedly secured to said second side wall along the upper marginal edge thereof and movable between open and closed positions, said outer closure flap overlying a portion of said inner closure flap when said closure flaps are in their closed positions, the length of the liner from top to bottom being greater than the length of said side walls from top to bottom, defining a liner upper portion which extends between said closure flaps when said closure flaps are in the open position, and means bonding said liner upper portion to a portion of the inner surface of said outer closure flap whereby, as said outer closure flap is moved between its open and closed positions, said liner upper portion is moved with said outer closure flapk said inner closure flap conforming in length and width to the length and width of the cross-section of the carton whereby when said inner closure flap is moved to its closed position, its outer marginal edge is located at the junction of said second side wall and said outer closure flap, with said outer marginal edge fitting tightly into the dihedral angle formed by said second side and said outer closure flap, pinching the liner therebetween along the entire length of said second side and said outer closure flap, and upon subsequent movement of said outer closure flap to its closed position, said liner upper portion of the liner is located between the outer surface of said inner closure flap and the inner surface of said outer closure flap, providing a substantially air-tight seal for the liner, and means bonding a portion of said liner to the carton near the bottom thereof whereby when said outer closure flap is moved to its open position, the liner is maintained under tension from top to bottom and when the carton is tilted for emptying the commodity therefrom, a portion of the liner end wall is forced open under the weight of the commodity directed thereto as the carton is tilted, forming a spout for directing the commodity to the centralized area upon discharge from the carton.

* * * * *